US007731188B2

(12) United States Patent
deJong et al.

(10) Patent No.: US 7,731,188 B2
(45) Date of Patent: Jun. 8, 2010

(54) SHEET REGISTRATION SYSTEM WITH AUXILIARY NIPS

(75) Inventors: Joannes N. M. deJong, Hopewell Junction, NY (US); Lloyd A. Williams, Mahopac, NY (US); Jack G. Elliot, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 49 days.

(21) Appl. No.: 11/879,578

(22) Filed: Jul. 18, 2007

(65) Prior Publication Data

US 2009/0020941 A1 Jan. 22, 2009

(51) Int. Cl.
*B65H 5/02* (2006.01)
*B65H 5/04* (2006.01)

(52) U.S. Cl. ..... 271/273; 271/264; 271/265.01; 271/3.2

(58) Field of Classification Search ..... 271/264, 271/265.01, 273, 3.2
See application file for complete search history.

(56) References Cited

U.S. PATENT DOCUMENTS

| | | | | |
|---|---|---|---|---|
| 4,971,304 | A | 11/1990 | Lofthus | 271/227 |
| 5,169,140 | A | 12/1992 | Wenthe, Jr. | 271/228 |
| 5,219,159 | A | 6/1993 | Malachowski et al. | 271/228 |
| 5,278,624 | A | 1/1994 | Kamprath et al. | 355/317 |
| 5,322,273 | A | 6/1994 | Rapkin et al. | 271/227 |
| 5,678,159 | A | 10/1997 | Williams et al. | 399/395 |
| 5,681,036 | A * | 10/1997 | Wakahara et al. | 271/10.12 |
| 5,697,608 | A | 12/1997 | Castelli et al. | 271/228 |
| 5,715,514 | A | 2/1998 | Williams et al. | 399/395 |
| 5,794,176 | A | 8/1998 | Milillo | 702/150 |
| 5,848,344 | A | 12/1998 | Milillo et al. | 399/395 |
| 5,994,711 | A | 11/1999 | Seachman et al. | 250/559.36 |
| 6,137,989 | A | 10/2000 | Quesnel | 399/394 |
| 6,168,153 | B1 * | 1/2001 | Richards et al. | 271/227 |
| 6,173,952 | B1 | 1/2001 | Richards et al. | 271/228 |
| 6,181,153 | B1 | 1/2001 | Mahanpour | 324/765 |
| 6,373,042 | B1 | 4/2002 | Kretschmann et al. | 250/208.1 |
| 6,511,239 | B1 | 1/2003 | Kretschmann et al. | 400/579 |
| 6,533,268 | B2 | 3/2003 | Williams et al. | 271/228 |
| 6,817,609 | B2 * | 11/2004 | Halvonik et al. | 271/228 |
| 6,836,627 | B2 | 12/2004 | Kretschmann et al. | 399/82 |
| 6,866,260 | B2 | 3/2005 | Williams et al. | 271/227 |
| 6,988,725 | B2 | 1/2006 | Rapkin | 271/227 |
| 7,293,769 | B2 * | 11/2007 | Asari et al. | 271/258.01 |
| 2004/0046316 | A1 * | 3/2004 | Tsuzawa | 271/264 |
| 2008/0073837 | A1 * | 3/2008 | DeGruchy | 271/273 |

* cited by examiner

*Primary Examiner*—Patrick Mackey
*Assistant Examiner*—Prasad V Gokhale
(74) *Attorney, Agent, or Firm*—Alix, Yale & Ristas, LLP

(57) ABSTRACT

A sheet handling system comprising a sheet registration system having sheet registration nips and a receiving system for a sheet including a capturing point for engaging said sheet. Auxiliary nips are positioned between the sheet registration nips and the receiving station. The auxiliary nips are moveable between an open and closed position. A controller receives a signal indicative of the length of the sheet and sends a signal to the auxiliary nips to be in a sheet engaging position when the length of the sheet is less than the distance between the sheet feeding nips and the capturing point of the receiving station and be in an open position if the length of the sheet is greater than the distance between the sheet registration nips and the capturing point of the receiving station. In another embodiment, the auxiliary nips are maintained in their open position until the trailing edge of a sheet is about to leave the sheet registration nips, at which point the auxiliary nips are closed.

15 Claims, 7 Drawing Sheets

SHEET REGISTRATION SYSTEM WITH AUXILIARY NIPS

TECHNICAL FIELD

This application relates generally to sheet registration systems, and more particularly, to sheet registration systems designed to accommodate sheets of different lengths.

BACKGROUND

Office equipment such as printers and copiers, which place images based on digital data onto sheets, such as sheets of paper are well known. In such equipment it is important that the sheet that is to receive the image is properly aligned with the edge of the feed path as well as not skewed so that the image is properly positioned on the sheet. Various types of registration systems to correct for skew and provide for positioning of the side edge of the sheet are know in the art.

One type of lateral registration system involves the use of a two nip differentially driven deskewing system. Such a system can provide lateral registration of the sheet by deskewing (differentially driving the two nips to remove any sensed initial sheet skew) and then deliberately inducing a fixed amount of sheet skew (rotation) with further differential driving, and driving the sheet forward while so skewed, thereby feeding the sheet sideways as well as forwardly, and then removing that induced skew after providing the desired amount of sheet side-shift providing the desired lateral registration position of the sheet edge.

One such system involving lateral registration using two nips includes a single motor driving spaced apart nips. A differential drive system is used for inducing the skew rotation of the sheet. The single motor is operatively connected to at least one of the nips through the differential drive system. The differential drive system provides relative differential angular movement to the spaced apart nips to achieve the desired amount of sheet deskewing movement.

Another type of system is a translating electronic registration (TELER) system. Such a system generally includes three optical sensors, a pair of coaxial independently driven drive rolls, a carriage with a linear drive on which paper drive rolls are mounted, and a microprocessor controller. A blank copy sheet is driven into the nip rolls and moved through the paper path for placement and fusing of an image thereon. The speed of both nip rolls can be controlled to effect skew alignment and longitudinal registration. The nip rollers are mounted on a carriage movable transversely with respect to the feed path. A sensor system controls positioning of the carriage to achieve the desired top edge or a lateral positioning of the sheet. Independent control of nip roll drive and carriage translation provides simultaneous alignment in lateral and longitudinal directions.

Examples of these systems may be found in U.S. Pat. No. 4,971,304 to Lofthus; U.S. Pat. No. 5,169,150 to Wenthe, Jr.; U.S. Pat. No. 5,219,159 to Malahowski et al; U.S. Pat. No. 5,278,624 to Kamprath et al; U.S. Pat. No. 5,794,176 to Milillo; U.S. Pat. No. 6,137,989 to Quesnel; U.S. Pat. No. 6,181,153 to Richards et al; U.S. Pat. No. 6,533,268 to Williams et al; and U.S. Pat. No. 6,866,260 to Lloyd et al. The disclosure of each of these patents is incorporated herein by reference in its entirety.

In U.S. Pat. Nos. 6,168,153 to Richards et al, 6,173,952 to Richards et al and 6,817,609 to Halvonik et al, the disclosure of each of which is incorporated herein by reference in its entirety, there is disclosed a sheet registration system in which the sheet is fed into the nips of a pre-transfer nip assembly unit. That unit feeds the sheet into the downstream receiving device (an image transfer station). Once the sheet has been fed far enough into the image transfer station to the position of the maximum tack point of electrostatic adhesion to the photoreceptor within the image transfer station, the nips of the pre-transfer nip assembly are automatically opened so the photoreceptor will control the sheet at that point. However, there is no relationship shown between the pre-transfer nip assembly unit and the sheet registration system.

The lateral registration systems shown in the above mentioned patents receive a sheet at its input or upstream end which may be misregistered and deliver it registered to a downstream receiving device for further processing. In moving through the registration system from input to output, the registration system typically moves the sheet in 2 or 3 degrees of freedom, (x, y, and theta, also known as process, lateral and skew) to achieve registration before the sheet lead edge is captured by the downstream receiving device.

A typical registration system must be capable of handling sheets of various lengths. An obvious constraint is that the distance between the output or hand-off location of the registration system and the point of capture of the sheet in the receiving device must be less than the length of the shortest sheet that is to be accommodated by the system. This unnecessarily constrains the length of the registration movement for long heavy-weight sheets that require the largest nip forces and tail wag (lateral swing of the tail edge of the sheet) to correct a given amount of input error as the sheet may become engaged by the receiving device before the registration is complete. This may place some limitations on the range of sheet sizes with which the system may be used.

SUMMARY

According to one embodiment there is provided a sheet handling system that comprises a sheet registration system having sheet registration nips. A receiving station is positioned downstream of said sheet registration system and includes a capturing point at which said sheet is engaged. Auxiliary nips are positioned between the sheet feeding nips and the receiving station. An actuator is provided for opening and closing said auxiliary nips. A controller is configured to receive a signal indicative of the length of a sheet passing through the registration system. The controller sends a signal to the actuator so that the auxiliary nips are closed when the length of said sheet is less than the distance between the sheet registration nips and the capturing point of the receiving station to engage the sheet and the auxiliary nips are in an open position if the length of the sheet is greater than the distance between the sheet registration nips and the capturing point.

According to another embodiment a sheet handling system is provided comprising a sheet registration system having sheet registration nips. A receiving station is positioned downstream of said sheet registration system and includes a capturing point for engaging the sheet. Auxiliary nips are positioned between the sheet feeding nips and the receiving station. An actuator is provided for opening and closing the auxiliary nips, the nips being maintained in a normally closed position. A controller is configured to receive a signal indicative of the length of the sheet passing through said registration system and a signal indicative of the time the registration system requires to perform sheet registration. The controller sends a signal to the actuator to open the auxiliary nips if the length of the sheet is greater than the distance between the sheet registration nips and the capturing point of the receiving station, and sheet registration will not be complete when the leading edge of the sheet arrives at the auxiliary nips based on the required time for sheet registration.

According to a further embodiment a sheet handling system is provided comprising a sheet registration system having sheet registration nips. A receiving station is positioned downstream of said sheet registration system and includes a capturing point at which said sheet is engaged. Auxiliary nips are positioned between the sheet registration nips and the receiving station. An actuator is provided for opening and closing said auxiliary nips. A controller is configured to receive a signal indicative of the length of said sheet passing through said registration system and a signal indicative of the time the registration system requires to perform sheet registration. The controller sends a signal to the actuator so that the auxiliary nips are opened if the length of the sheet is less than the distance between the sheet registration nip and capturing point and sheet registration will not be complete when the leading edge of the sheet arrives at the auxiliary nips based on the required time for sheet registration, and a signal to close the nips when said sheet registration is complete.

According to yet another embodiment, a sheet handling system is provided that comprises a sheet registration system having sheet registration nips. A receiving system is position downstream of said sheet registration system and includes a capturing point for engaging the sheet. Auxiliary nips are positioned between the sheet registration nips and the receiving station. The auxiliary nips are moveable between an open unengaged position and a closed engaged position. An actuator is provided for opening and closing the auxiliary nips, the auxiliary nips being open as said sheet is passing through said sheet registration nips. A controller is configured to receive a signal indicative of the time when the trailing edge of the sheet is about to leave said sheet registration nips, said controller sending a signal to said actuator to close the auxiliary nips as the trailing edge of said sheet is about to leave said registration nips.

DETAILED DESCRIPTION

Figure 1:
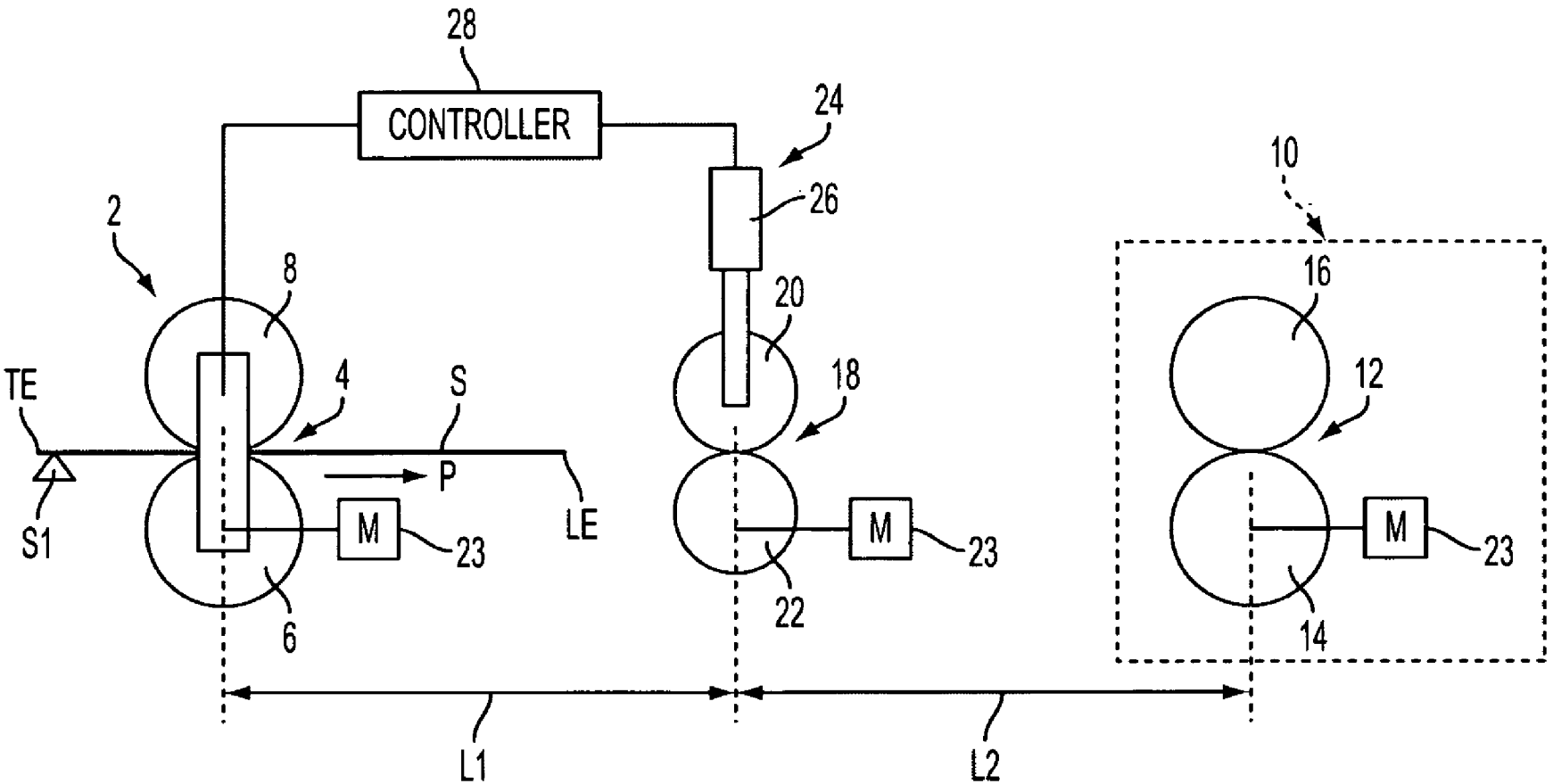
FIG. 1 is a schematic elevational view showing one aspect of the disclosure with the components positioned when a short sheet is being fed and the sheet is still in the sheet registration nips.

Referring to the drawings, and particularly FIG. 1, a sheet registration system 2 is shown schematically that includes a set of downstream registration nips 4 at its downstream or outlet end. Each nip 4 may be formed by a drive roll 6 and a mating idler roll 8 in vertically alignment therewith. The mating rolls 6 and 8 frictionally engage a sheet S to feed the sheet in the direction of the path P. The set of registration nips 4 may include two or more nips 4, each having a drive roll 6 and a mating idler roll 8 which are spaced along a horizontal axis perpendicular to the path P of the sheet S. The sheet S is shown being driven by the nips 4. The sheet registration system 2 serves to align the sheet in the x and y directions and remove any skew. It is understood that the sheet registration system may be of any type such as one of those shown and described in the above mentioned patents.

A receiving station shown schematically by the reference numeral 10 is positioned in the path P of the sheet S downstream of the sheet registration system 2. The receiving station 10 is shown as including a set of receiving nips 12 at its upstream or input end which include a drive roll 14 and an idler roll 16 in vertical alignment. Although the receiving device 10 is shown as having receiving device nips 12, such nips 12 are not required nor does the receiving device necessarily include nips. Rather, the receiving device 10 may capture the sheet by some mechanism such as an image bearing member using electrostatics as in the case where the receiving device is an image transfer station. The receiving device nips 12 as shown in the drawings are intended to schematically represent the point at which a sheet capturing mechanism in the receiving device 10 captures the sheet and controls its movement regardless of the means used to accomplish such capture and control. The receiving station 10 may be a photoreceptor or any other device to which a registered sheet S is to be fed.

Positioned between the registration nips 4 and the receiving station 10 is a set of auxiliary nips 18. As with the case of the other nips, each auxiliary nip 18 may comprise an idler roll 20 and a drive roll 22 in vertical alignment to provide frictional engagement of the sheet S when in the closed position. The set may include two or more such nips 18, each having a drive roll 22 and an idler roll 20 spaced apart along a horizontal axis perpendicular to the path P of a sheet S. The drive rolls 22, as well as the drive rolls 6 and 14, are driven by suitable motors 23.

The auxiliary nips 18 are adapted to be actuated between an open position in which the rolls 20 and 22 are spaced apart and a sheet S may pass through unobstructed, and a closed position wherein the rolls 20 and 22 are together in frictional driving engagement with the sheet S. Any type of suitable actuator 24 may be used to move the rolls 20 and 22 between their open and closed position. For example, the idler roll 20 may be moved toward and away from its respective drive roll 22 by a solenoid 26. Alternatively, an arrangement similar to that shown in U.S. Pat. Nos. 6,168,153, 6,173,952 and 6,817,609 may be used. As shown and described in those patents, a cam shaft may be used to lift and disengage the idler rolls 20 from their mating nip-forming drive rolls 22.

The actuator 24 for causing the engagement and disengagement of the auxiliary nips 18 is connected to a controller 28 which sends a signal to the actuator 24 to initiate the opening and closing of the auxiliary nips 18 at the proper time and circumstance. The auxiliary nips 18 are positioned a distance L1 downstream along the path P of the sheet S from the registration nips 4. This distance L1 is slightly less than the length of the shortest sheet that is intended to be used in the device. The receiving device nips 12 are located a distance L2 downstream from auxiliary nips. This distance L2 is also slightly less than the length of the shortest sheet.

In operation, a sheet length control signal is provided to the controller 28 which is indicative of the length of the sheet being fed. The sheet length control signal may be from a conventional sheet length sensor S1 measuring the sheet transit time in the sheet path between the trailing edge TE and leading edge LE of the sheet S. Such a sensor may be mounted at or upstream of the sheet input into the sheet registration system. Alternatively, the sheet length control signal may be provided to the controller 28 by operator input or automatically by sheet feeding tray or cassette selection.

Figure 2:
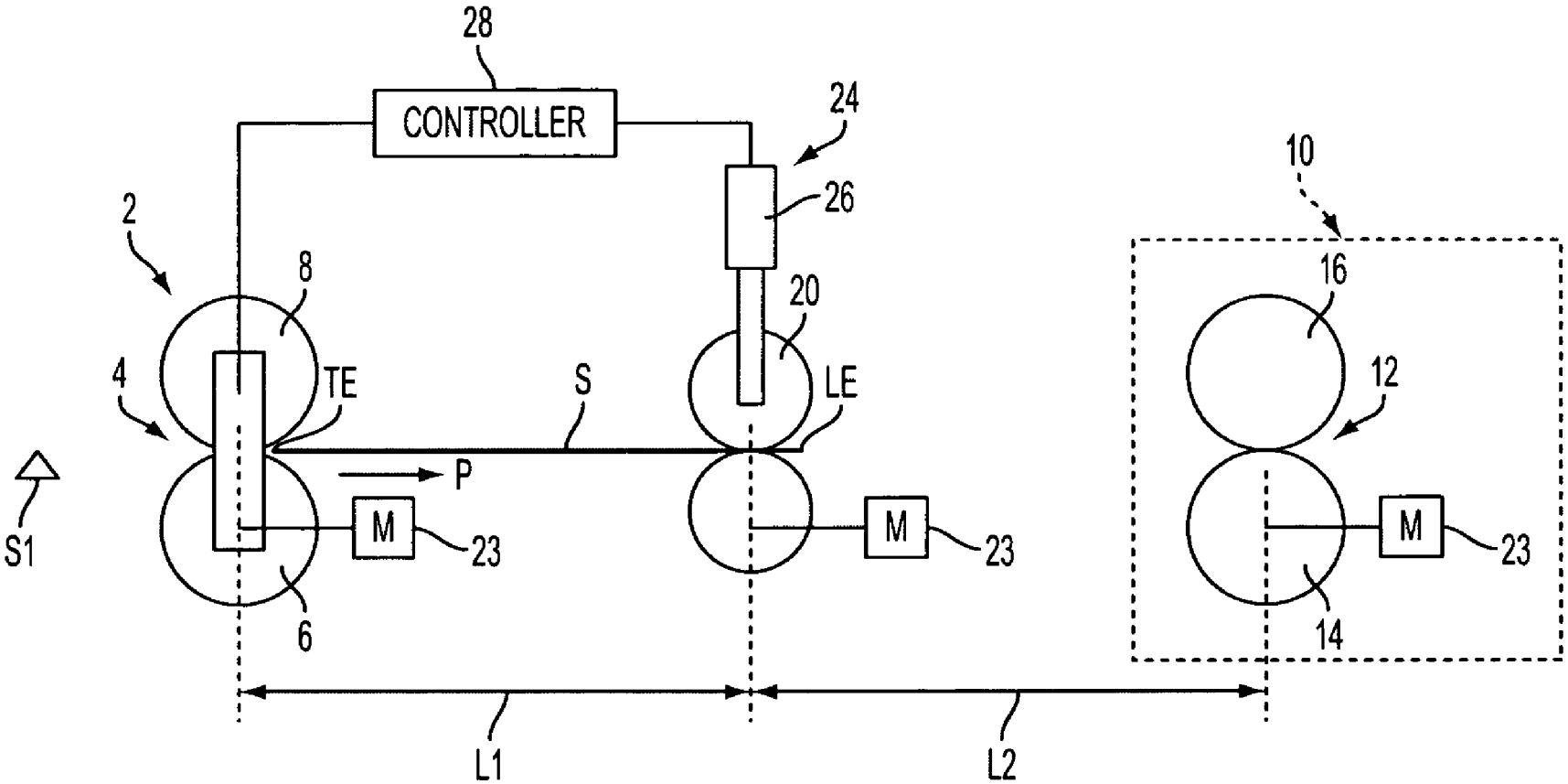
FIG. 2 is a view similar to FIG. 1 but showing the components positioned just after the short sheet has left the sheet registration nips.
Figure 3:
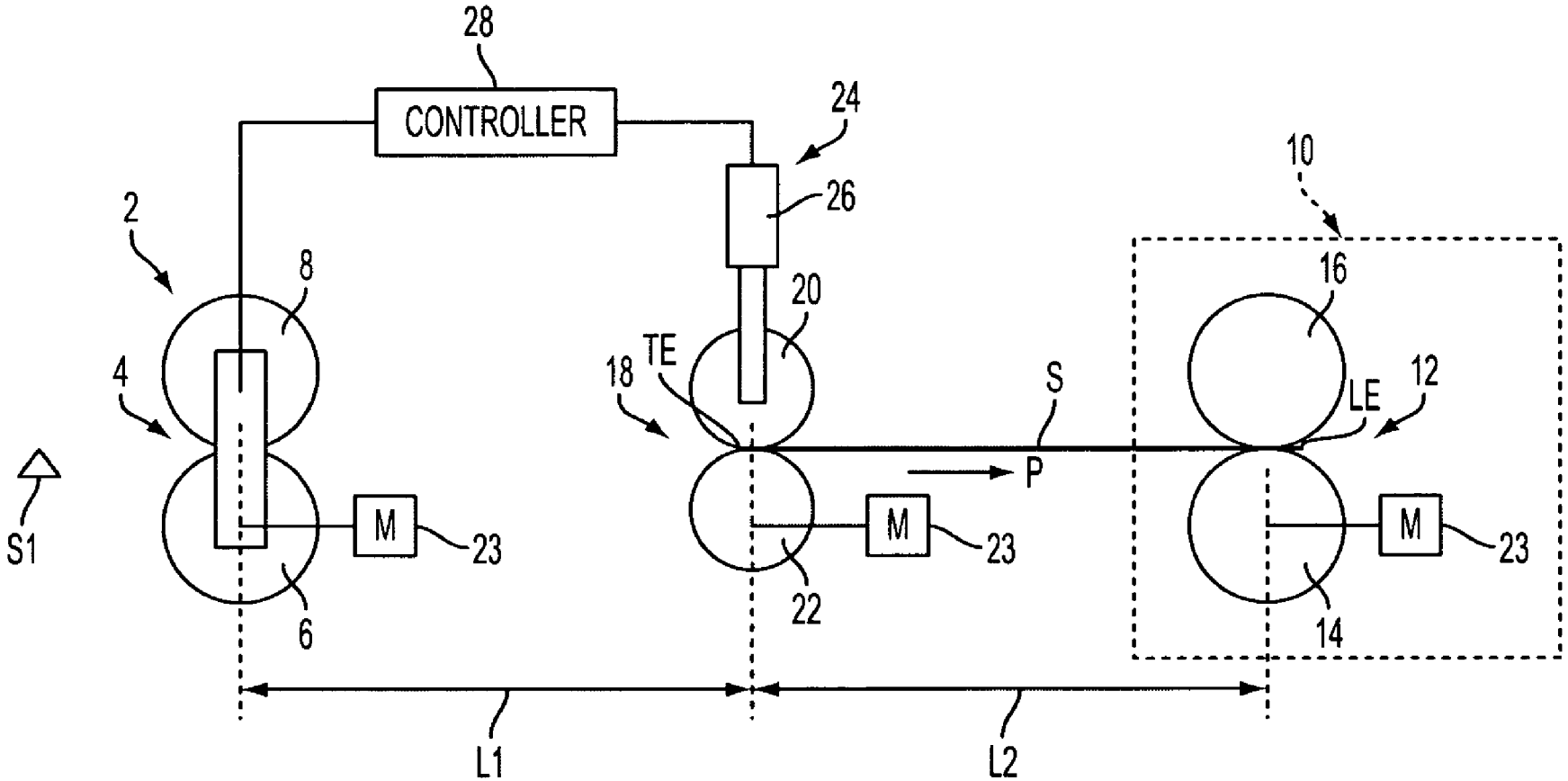
FIG. 3 is a view similar to FIG. 1, but showing the components when the short sheet enters the receiving device.

When a short sheet S (the shortest sheet that is intended to be used in the device) is being fed, if the normal position of the auxiliary nips 18 is in the closed engaged feeding position, then the controller 28 maintains the auxiliary nips 18 in the closed position and does not send an actuating signal to the actuator 24. The components will be as shown in FIG. 1 with the sheet being fed by the sheet registration nips 4 toward the auxiliary nips 18 which are in their closed feeding position. As the short sheet S is leaving the sheet registration nips 4, the short sheet S is engaged by the auxiliary nips 18 which then feed the sheet S toward the receiving device 10 as shown in FIG. 2. As the trailing end TE of the short sheet S is about to leave the auxiliary nips 18, the leading edge LE of the short sheet S is engaged by the receiving device nips 12 which continues to feed the sheet as shown in FIG. 3. As will be noted from FIGS. 1-3, the short sheet is continuously engaged by a nip as it travels from the registration system 2 to the receiving device 10.

Figure 4:
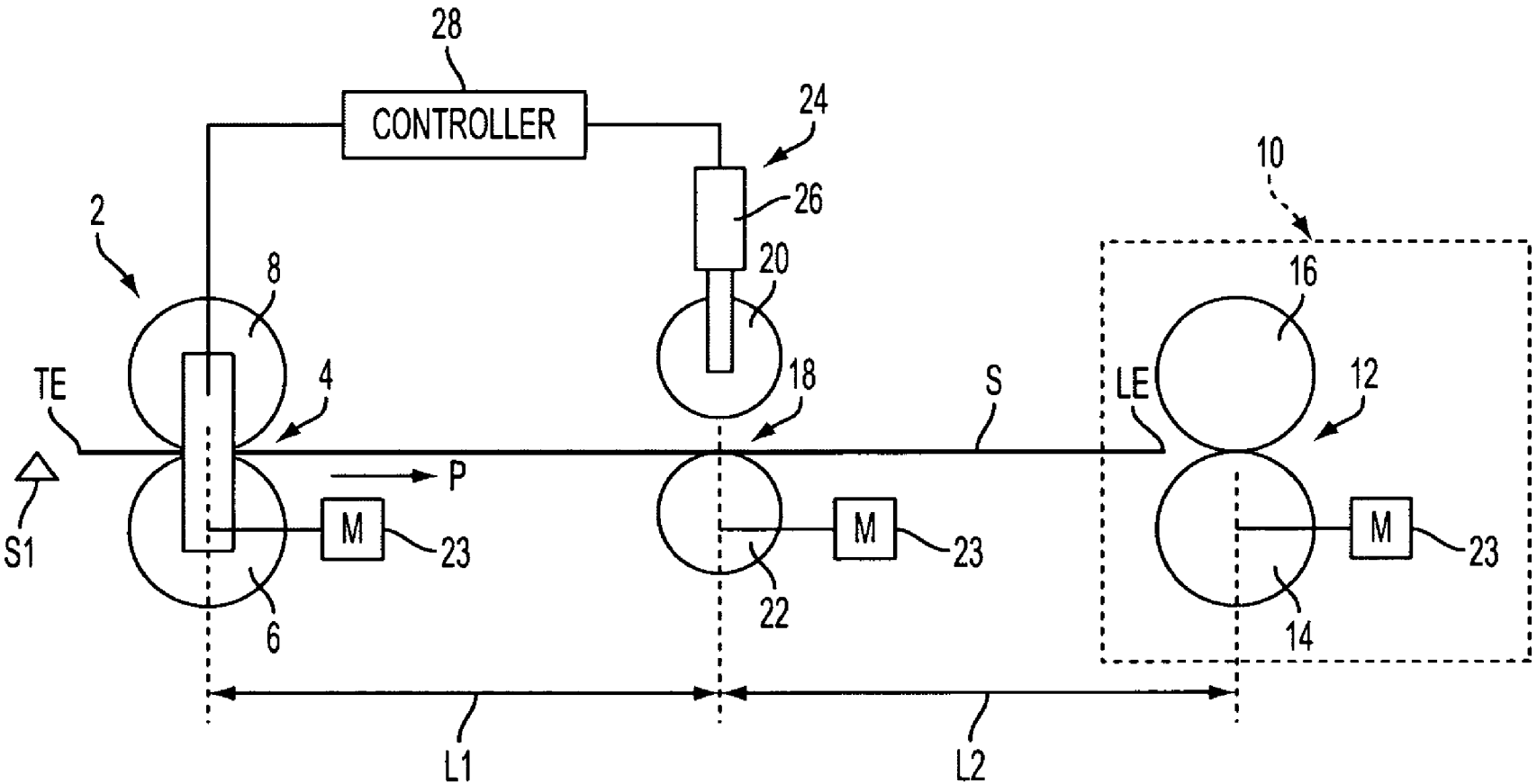
FIG. 4 is a view similar to FIG. 1, but showing the components positioned when a long sheet is being fed and the sheet is still in the sheet registration nips.
Figure 5:
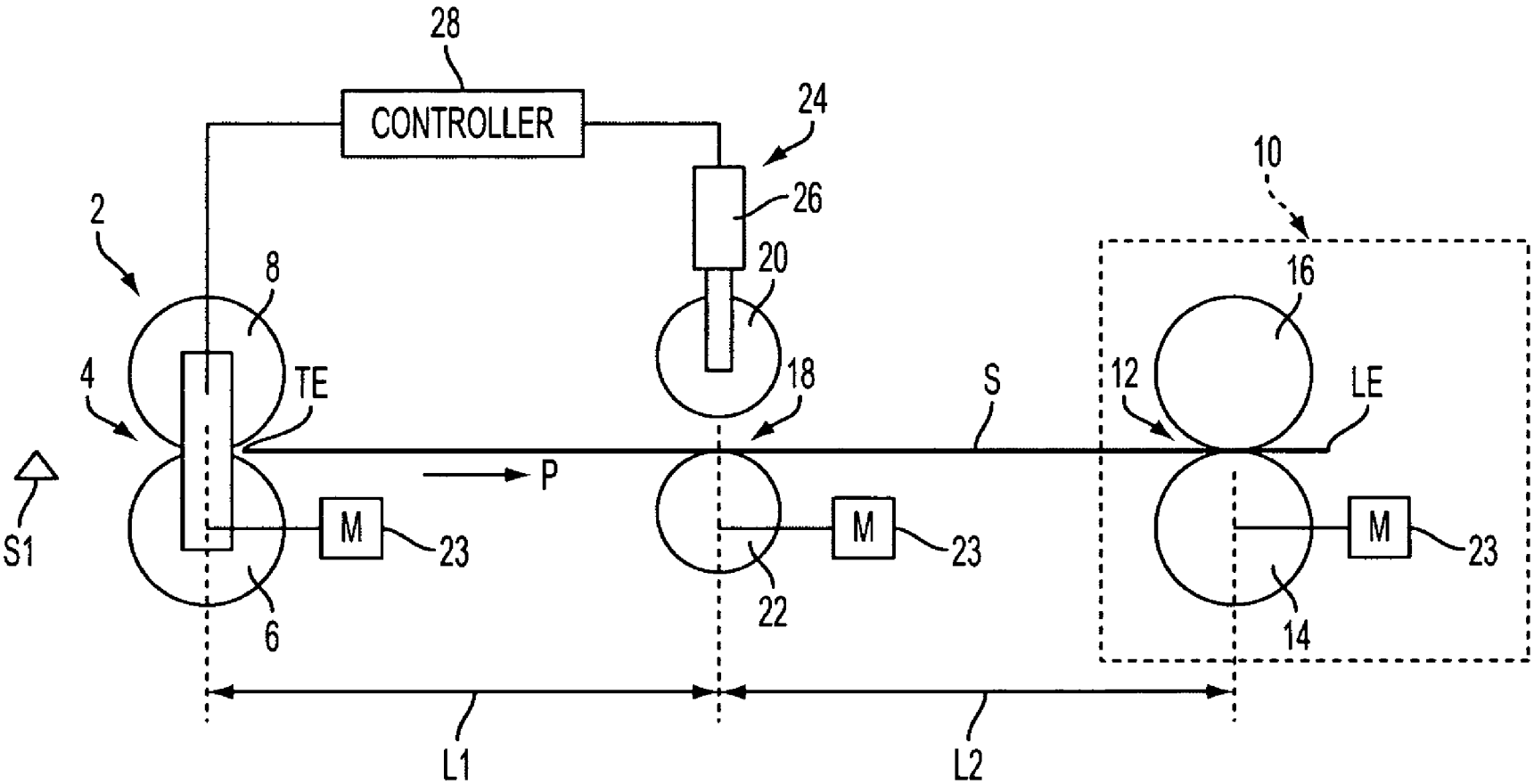
FIG. 5 is a view similar to FIG. 4, but showing the components positioned as the long sheet enters the receiving device.

Referring to FIGS. 4 and 5, when a long sheet S is fed, the controller 26 will receive a sheet length signal as described above indicating the presence of a long sheet, which is one that has a length greater than the distance between the sheet registration system 2 and the receiving device nips 12. The controller 26 may also receive a registration time signal, indicating whether or not sheet registration will be complete by the time the sheet arrives at the auxiliary nips 18. In the case of the long sheet, the controller 28 will process the sheet control signal and the registration time signal and then determine if the auxiliary nips 18 should be opened. The auxiliary nips 18 will be opened if the sheet S is a long sheet and the registration of the sheet S will not be complete when the leading edge of the sheet S arrives at the auxiliary nips 18 based on the required time for sheet registration. An appropriate signal is sent to the actuator 24 which will cause the auxiliary nips 18 to open in the position as shown in FIG. 4. In case of the long sheet S, the signal for the opening of the auxiliary nips 18 should be transmitted to the actuator 24 in time for the auxiliary nips 18 to be opened prior to the leading edge LE of the long sheet S reaching the auxiliary nips 18.

In the case of the long sheet S, the auxiliary nips 18 can remain open throughout the entire travel of the long sheet from the registration system 2 to the receiving device 12. After the trailing edge of the long sheet S has passed the auxiliary nips 18, the auxiliary nips 18 can be reset to their normal closed position.

When an intermediate length sheet S is fed, the controller 26 will receive a sheet length signal as described above indicating the presence of an intermediate length sheet which is one that has a length greater than the shortest sheet and a length that is less than the distance between the sheet registration system 2 and the receiving device nips 12. The controller 26 may also receive a registration time signal, indicating whether or not sheet registration will be complete by the time the sheet arrives at the auxiliary nips 18. In the case of the intermediate length sheet, the controller 28 will process the sheet control signal and the registration time signal and then determine if the auxiliary nips 18 should be opened. The auxiliary nips 18 will be opened if the sheet S is an intermediate length sheet and the registration of the sheet S will not be complete when the leading edge of the sheet S arrives at the auxiliary nips 18 based on the required time for sheet registration. An appropriate signal is sent to the actuator 24, which will cause the auxiliary nips 18 to open. In case of the intermediate length sheet S, the signal for the opening of the auxiliary nips 18 should be transmitted to the actuator 24 in time for the auxiliary nips 18 to be opened prior to the leading edge LE of the intermediate length sheet S reaching the auxiliary nips 18. When the registration move is complete the auxiliary nips 18 are reset to their normal closed position.

Figure 6:
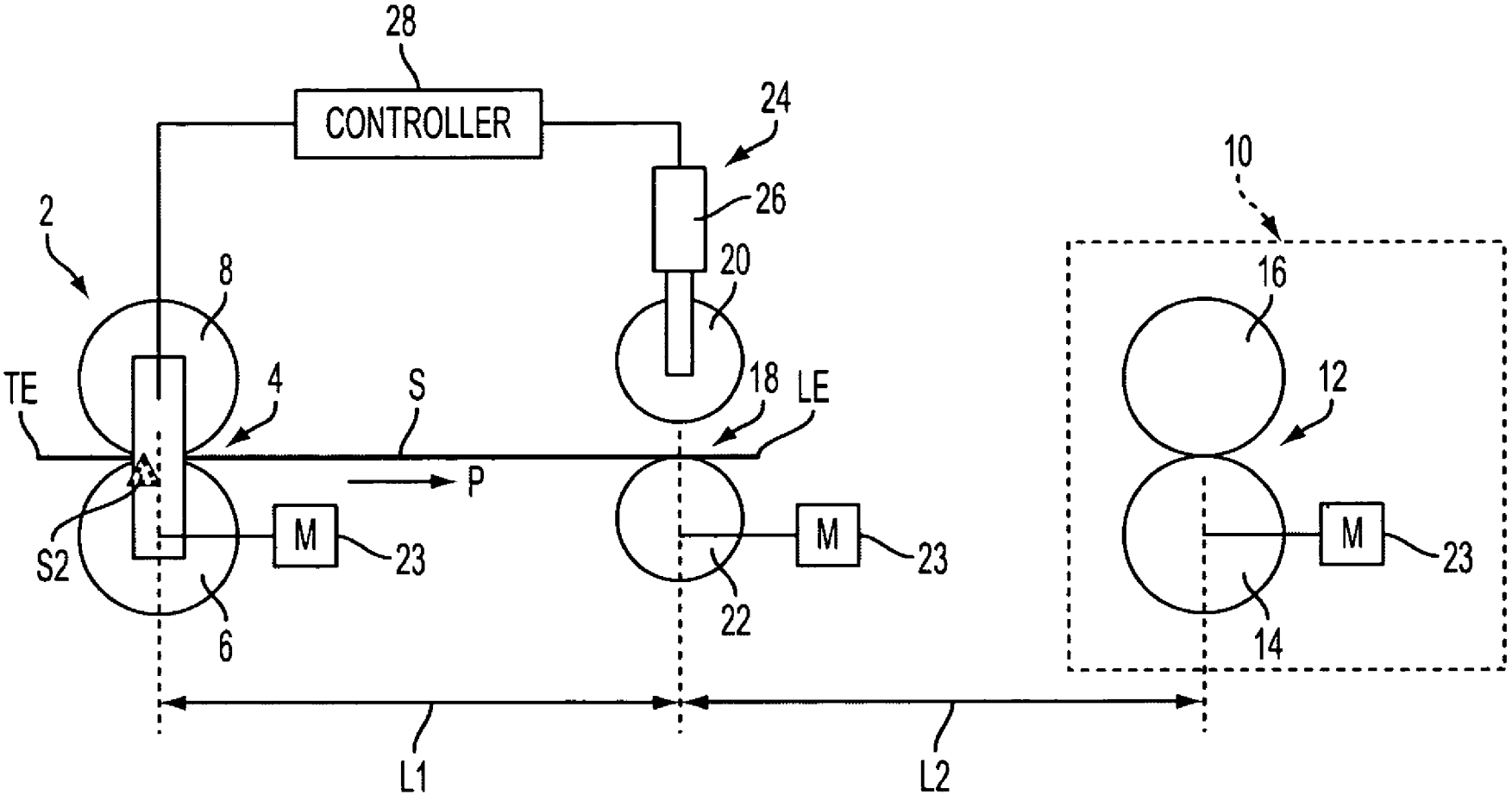
FIG. 6 is a schematic elevational view of another aspect of the disclosure showing a sheet being fed while still in the nips of the sheet registration system.
Figure 7:
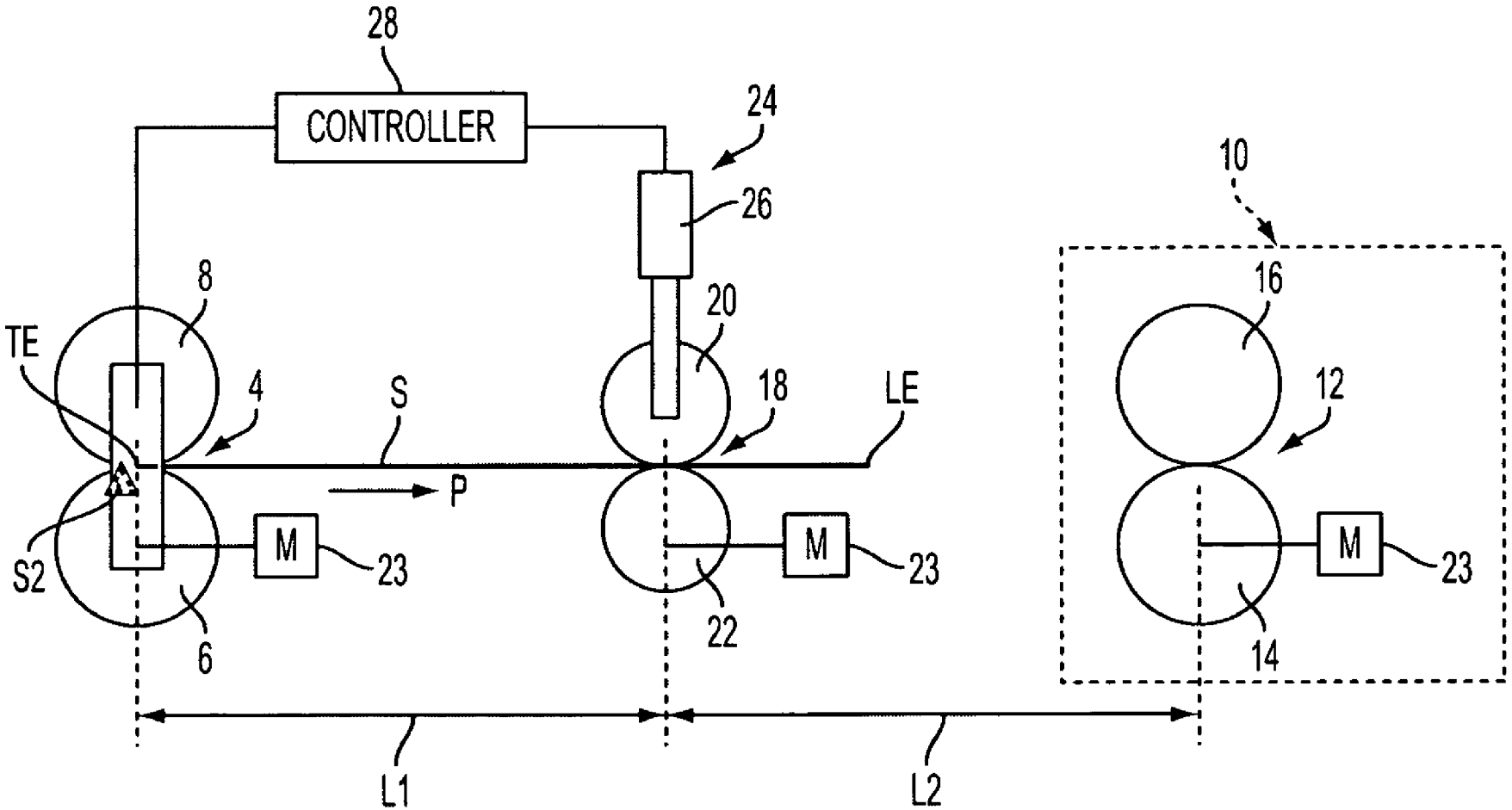
FIG. 7 is a view similar to FIG. 6 but showing the components positioned just before the sheet leaves the sheet registration nips.

A second embodiment is shown in FIGS. 6 and 7. According to this embodiment, the auxiliary nips 18 are maintained in a normally open position and remain in that position as the sheet S exits from the sheet registration nips 4. In the case of this aspect, the controller 28 receives a signal when the trailing edge TE of the sheet S is about ready to exit the sheet registration nips. The signal may be from a conventional sheet sensor S2 mounted slightly upstream of the sheet registration nips 4. Alternatively, the signal can result from the calculation of sheet positioning during the registration process. Another means of providing a signal is in response to the completion of the registration process by the registration system 2.

Regardless of the length of the sheet S, as it passes through the sheet registration nips 4, the auxiliary nips 18 remain open as shown in FIG. 6. As the sheet S is about to exit the sheet registration nips 4 the controller 26 sends a signal to the actuator 24 to initiate the closing of the auxiliary nip 18 as shown in FIG. 7. The signal for closing of the auxiliary nips 18 should be transferred to the actuator 24 in time for the auxiliary nips 18 to be closed prior to the trailing edge TE of the sheet S leaving the registration nips 4. At this time, the registration process in the sheet registration system 2 will have been completed. The auxiliary nips 18 will remain closed at least until the leading edge LE of the sheet S has been engaged by the receiving device nips 12, at which time the auxiliary nips 18 may be reset to their normal open position.

While various embodiments have been shown and described, various modifications and substitutions may be made thereto. Accordingly, it is understood that the present embodiments have been described by way of illustration and not limitation.

The invention claimed is:

1. A sheet handling system comprising a sheet registration system having sheet registration nips;

a receiving station downstream of said sheet registration system including a capturing point at which said sheet is engaged;

auxiliary nips positioned between said sheet registration nips and said receiving station;

an actuator for opening and closing said auxiliary nips; and a controller configured to receive a signal indicative of the length of said sheet passing through said registration system, said controller sending a signal to said actuator so that said auxiliary nips are closed when the length of said sheet is less than the distance between said sheet registration nips and said capturing point and said auxiliary nips are in an open position if the length of said sheet is greater than the distance between said sheet registration nips and said capturing point, said auxiliary nips being maintained in a normally closed position, said controller capable of sending a signal to said actuator to initiate the opening of said nips when a sheet having a length greater than the distance between said sheet registration nips and said capturing point of said receiving station is being fed and before the leading edge of the sheet having a length greater than the distance between said sheet registration nips and said capturing point of said receiving station reaches said auxiliary nips, and resetting said auxiliary nips back to their closed position after the trailing edge of said sheet has passed downstream of the auxiliary nips.

2. The sheet handling system of claim 1 further including said controller configured to receive a signal indicative of the time the registration system requires to perform sheet registration, said controller sending a signal to the actuator so that the auxiliary nips are opened if the length of the sheet is greater than the distance between the sheet registration nip and capturing point and sheet registration will not be complete when the leading edge of the sheet arrives at the auxiliary nips based on the required time for sheet registration.

3. The sheet handling system of claim 1 wherein the distance between the sheet registration nips and the auxiliary nips is a predetermined distance that is equal to or less than the length of the shortest sheet for which the system is intended to handle and the distance between the auxiliary nips and said capturing point of said receiving station is equal to or less than the length of the shortest sheet for which the system is intended to handle.

4. The sheet handling system of claim 1 wherein the distance between said sheet registration nips and said capturing point of said receiving station is equal to or less than the length of the longest sheet the system is intended to handle.

5. The sheet handling system of claim 1 wherein said auxiliary nips include at least one drive roll and one mating idler roll.

6. The sheet handling system of claim 5 further including a drive device for driving said drive roll of said auxiliary nips.

7. The sheet handling system of claim 1 wherein said signal indicating the length of said sheet is initiated by a sheet sensor positioned in the path of the sheet.

8. A sheet handling system comprising a sheet registration system having sheet registration nips;

a receiving station downstream of said sheet registration system including a capturing point for engaging said sheet;

auxiliary nips positioned between said sheet registration nips and said receiving station, said auxiliary nips being moveable between an open unengaged position and a closed engaged position;

an actuator for opening and closing said auxiliary nips, said auxiliary nips being open as said sheet is passing through said sheet registration nips a controller configured to receive a signal indicative of the time when the trailing edge of said sheet is about to leave said sheet registration nips, said controller sending a signal to said actuator to close the auxiliary nips as the trailing edge of said sheet is about to leave said registration nips.

9. The sheet handling system of claim 8 wherein the distance between the sheet registration nips and the auxiliary nips is a predetermined distance that is equal to or less than the length of the shortest sheet for which the system is intended to handle and the distance between the auxiliary nips and said capturing point of said receiving station is equal to or less than the length of the shortest sheet for which the system is intended to handle.

10. The sheet handling system of claim 9 wherein the distance between said sheet registration nips and said capturing point of said receiving station is equal to or less than the length of the longest sheet the system is intended to handle.

11. The sheet handling system of claim 8 further including a sensor positioned immediately upstream of said sheet registration nips for providing said signal indicative of the time the trailing edge of said sheet is about to leave said registration nips.

12. The sheet handling system of claim 11, wherein said auxiliary nips are set to their open position after the trailing edge of said sheet has passed downstream of the auxiliary nips.

13. The sheet handling system of claim 8 wherein said auxiliary nips are maintained in a normally open position, said controller sending a signal to said actuator to initiate the closing of said nips when the trailing edge of said sheet is about to leave said sheet registration nips.

14. The sheet handling system of claim 13 wherein said signal is sent to said actuator after the registration process in the registration system is complete.

15. The sheet handling system of claim 14, wherein said auxiliary nips are reset back to their open position after the trailing edge of said sheet has passed downstream of the auxiliary nips.

* * * * *